US011215105B2

(12) United States Patent
Hayakawa et al.

(10) Patent No.: US 11,215,105 B2
(45) Date of Patent: Jan. 4, 2022

(54) MUFFLER SYSTEM

(71) Applicant: FUTABA INDUSTRIAL CO., LTD., Okazaki (JP)

(72) Inventors: Toru Hayakawa, Okazaki (JP); Naoki Matsumoto, Okazaki (JP); Masaya Takeuchi, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 421 days.

(21) Appl. No.: 16/232,200

(22) Filed: Dec. 26, 2018

(65) Prior Publication Data

US 2019/0211737 A1 Jul. 11, 2019

(30) Foreign Application Priority Data

Jan. 5, 2018 (JP) ..... JP2018-000686

(51) Int. Cl.
*F01N 13/18* (2010.01)
*G10K 11/16* (2006.01)
(Continued)

(52) U.S. Cl.
CPC ..... *F01N 13/1838* (2013.01); *F01N 1/003* (2013.01); *F01N 13/16* (2013.01);
(Continued)

(58) Field of Classification Search
CPC ..... F01N 2450/22; F01N 2470/18; F01N 13/1838; F01N 13/1844; F01N 2260/18;
(Continued)

(56) References Cited

U.S. PATENT DOCUMENTS 2,692,025 A * 10/1954 Maxim ..... F01N 1/08 181/238
2,739,661 A * 3/1956 Powers ..... F01N 1/02 181/276

(Continued)

FOREIGN PATENT DOCUMENTS

CN 105026719 A 11/2015
DE 19947938 A1 4/2001

(Continued)

OTHER PUBLICATIONS

Examination Report under Sections 12 & 13 of the Patents Act for Indian Patent Application No. 201834049416 dated Jul. 20, 2020, 5 pages.

(Continued)

*Primary Examiner* — Jeremy A Luks
(74) *Attorney, Agent, or Firm* — Withrow & Terranova, P.L.L.C.; Vincent K. Gustafson

(57) ABSTRACT

A muffler system with a muffler in one aspect of the present disclosure includes an outer wall, and a first separator and a second separator that partition a muffling space. An attachment member is arranged on an outer surface of the outer wall, and a muffler pipe to communicate with the muffling space is arranged to pass through an attachment member hole in the attachment member. The outer surface of the outer wall includes a first area and a second area. The first area is located between a first end of the muffling space and the first separator, and the second area is located between a second end of the muffling space and the second separator. The attachment member is welded to the first and second areas of the outer surface of the outer wall.

14 Claims, 5 Drawing Sheets

(51) Int. Cl.

| | |
|---|---|
| ***G10K 11/172*** | (2006.01) |
| ***F01N 1/00*** | (2006.01) |
| ***F01N 13/16*** | (2010.01) |
| ***G10K 11/162*** | (2006.01) |

(52) U.S. Cl.
CPC ..... *G10K 11/161* (2013.01); *G10K 11/162* (2013.01); *G10K 11/172* (2013.01); *F01N 2530/04* (2013.01)

(58) Field of Classification Search
CPC ..... F01N 13/16; F01N 1/003; F01N 2530/04; G10K 11/161; G10K 11/162; G10K 11/172
See application file for complete search history.

(56) References Cited

U.S. PATENT DOCUMENTS

| | | | | |
|---|---|---|---|---|
| 3,703,938 | A | 11/1972 | Nelson | |
| 3,776,366 | A * | 12/1973 | Betts | F01N 1/08 181/239 |
| 6,241,044 | B1 * | 6/2001 | Nishiyama | F01N 1/083 181/227 |
| 8,205,713 | B2 * | 6/2012 | Gorke | F01N 13/1838 181/212 |
| 8,292,026 | B2 * | 10/2012 | Tauschek | F01N 1/023 181/251 |
| 10,208,639 | B2 * | 2/2019 | Lee | F01N 1/026 |
| 2015/0354433 | A1 | 12/2015 | Namikiri et al. | |
| 2016/0040566 | A1 | 2/2016 | Barole et al. | |
| 2019/0120115 | A1 * | 4/2019 | Zdravkov | F01N 1/023 |
| 2019/0145297 | A1 * | 5/2019 | LeRoy | G10K 11/04 181/265 |

FOREIGN PATENT DOCUMENTS

| | | | |
|---|---|---|---|
| JP | H02119924 | U | 9/1990 |
| JP | 2002089232 | A | 3/2002 |
| JP | 2008115799 | A | 5/2008 |
| JP | 5424054 | B2 | 2/2014 |
| JP | 2016176126 | A | 10/2016 |
| KR | 101516481 | B1 | 4/2015 |
| WO | 2014109389 | A1 | 1/2017 |

OTHER PUBLICATIONS

First Office Action for Chinese Patent Application No. 201811602198.5 dated Sep. 1, 2020 (17 pages including English translation).
Decision of Refusal for Japanese Patent Application No. 2018-000686 dated Feb. 25, 2020 (6 pages including English translation).
Notice of Reasons for Refusal for Japanese Patent Application No. 2018-000686 dated Dec. 10, 2019 (6 pages including English translation).

* cited by examiner

MUFFLER SYSTEM

CROSS-REFERENCE TO RELATED APPLICATIONS

This application claims the benefit of Japanese Patent Application No. 2018-686 filed on Jan. 5, 2018 with the Japan Patent Office, the entire disclosure of which is incorporated herein by reference.

BACKGROUND

The present disclosure relates to a muffler system provided in an exhaust flow path from an engine of a vehicle.

Japanese Unexamined Patent Application Publication No. 2008-115799 describes an example of a muffler provided with an inlet pipe projecting sideward from a shell. In the muffler, the inlet pipe is held by a stay provided inside the muffler. Also, a closing member welded on an outer surface of the shell covers an area around a hole in the shell through which the inlet pipe passes. The closing member externally closes a gap between the inlet pipe and the shell, and also enables more secure coupling between the inlet pipe and the shell.

SUMMARY

An external force may be applied to the inlet pipe, and as a result, a force may act on the closing member in a direction of separating from the outer surface of the shell. Also, such external force may cause deformation of the shell, and the deformation may cause a force of separating the closing member from the shell.

It is preferable to more securely couple a pipe and a muffler.

One embodiment of the present disclosure is a muffler system provided in an exhaust flow path from an engine of a vehicle and having a muffler. The muffler system comprises an outer wall, a first separator, a second separator, a muffler pipe, and an attachment member.

The outer wall covers a muffling space inside the muffler. The first separator is a plate-like member arranged to face a first end of the muffling space and partition the muffling space. A first separator coupling portion that is provided at an edge of the first separator is joined to an inner side of the outer wall. The second separator is a plate-like member arranged, between the first separator and a second end of the muffling space opposing the first end, to face the second end and partition the muffling space. A second separator coupling portion that is provided at an edge of the second separator is joined to the inner side of the outer wall.

The muffling space comprises an intermediate space defined between the first separator and the second separator. A muffler pipe is arranged to pass through an outer wall hole provided in a part of the outer wall covering the intermediate space, such that the muffler pipe communicates the intermediate space with an exterior space of the muffler.

The attachment member is a plate-like member having an attachment member hole and an attachment member coupling portion surrounding the attachment member hole. The attachment member is arranged along an outer surface of the outer wall, and the muffler pipe is arranged to pass through the attachment member hole and secured to the attachment member coupling portion.

The outer surface of the outer wall comprises a first area and a second area. The first area is located between the first end and an area facing the first separator coupling portion, and the second area is located between the second end and an area facing the second separator coupling portion. The attachment member is welded to at least the first area and the second area of the outer surface of the outer wall.

Providing the first and second separators inside the muffler as described above allows the first and second areas of the outer wall to have a rigidity higher than that in an area between the first area and the second area. Also, the attachment member is welded to both of the first and second areas. Thus, even if an external force is applied to the muffler pipe, deformation of a part of the outer wall covered with the attachment member is reduced. Accordingly, separation of the attachment member from the outer surface of the outer wall is reduced, and more secure coupling of the pipe and the muffler can be achieved.

According to one embodiment of the present disclosure, the outer wall may comprise a shell, a first end plate, and a second end plate. The shell has a tubular configuration extending between the first end and the second end. The first end plate is a plate-like member covering the first end. The second end plate is a plate-like member covering the second end.

With this configuration, the muffler pipe is arranged to pass through the outer wall hole in the shell, and the attachment member is joined to the first area and the second area of the outer surface of the shell. Accordingly, separation of the attachment member from the outer surface of the shell is reduced, and more secure coupling of the pipe and the muffler can be achieved.

According to one embodiment of the present disclosure, the outer wall may extend between the first end and the second end, and may have a columnar configuration having a substantially oval cross section orthogonal to an extending direction of the outer wall. With this configuration, similar effects as described above can be also obtained.

According to one embodiment of the present disclosure, the outer surface of the outer wall may comprise a short diameter area extending along a short diameter direction of the cross section. The outer wall hole may be provided to be located at least partially in the short diameter area. With this configuration, similar effects as described above can be also obtained.

According to one embodiment of the present disclosure, the muffler system may further comprise a support member that is a plate-like member having a support member hole and a support member coupling portion surrounding the support member hole, and is arranged in the intermediate space with the muffler pipe passing through the support member hole. The support member may be joined to the inner side of the outer wall. The support member coupling portion may support a lateral surface of the muffler pipe.

With this configuration, the lateral surface of the muffler pipe is supported by the support member in the muffling space. Thus, if an external force is applied to the muffler pipe, change of an orientation of the muffler pipe is reduced, and also deformation of the outer wall is reduced. Accordingly, separation of the attachment member from the outer surface of the outer wall is reduced, and more secure coupling of the pipe and the muffler can be achieved.

According to one embodiment of the present disclosure, the outer wall may extend between the first end and the second end, and may have a columnar configuration having a substantially oval cross section orthogonal to an extending direction of the outer wall. The outer surface of the outer wall may comprise a first long diameter area and a second long diameter area each extending along a long diameter direction of the cross section. The support member may be joined to an inner side of the first long diameter area and to an inner side of the second long diameter area. With this configuration, the support member can be joined to the muffler more securely.

According to one embodiment of the present disclosure, the attachment member may comprise a substantially quadrangular member. Also, at least two of four corner portions of the attachment member may be welded to the first area, and the remaining two of the four corner portions may be welded to the second area. With this configuration, more secure welding of the attachment member to the outer wall can be achieved with reduced cost.

According to one embodiment of the present disclosure, the attachment member may comprise a substantially rectangular portion extending along a longitudinal direction. Also, one end of the substantially rectangular portion along the longitudinal direction may comprise at least one welding portion welded to the first area, and the other end of the substantially rectangular portion along the longitudinal direction may comprise at least one welding portion welded to the second are.

With this configuration, if an external force is applied to the muffler pipe, deformation of a part of the outer wall covered with the attachment member is reduced, and thus, separation of the attachment member from the outer surface of the outer wall is reduced. Accordingly, more secure coupling of the pipe and the muffler can be achieved.

According to one embodiment of the present disclosure, the outer wall may comprise an outer wall coupling portion that is a wall-like portion surrounding the outer wall hole and projecting from an edge of the outer wall hole outward of the muffler. Also, the attachment member coupling portion may be a wall-like portion surrounding the attachment member hole and projecting from an edge of the attachment member hole outward of the muffler, and the attachment member coupling portion may be arranged outward of the outer wall coupling portion. The outer wall coupling portion, the attachment member coupling portion, and the muffler pipe may be welded together. With this configuration, more secure coupling of the pipe and the muffler can be achieved.

According to one embodiment of the present disclosure, the muffler pipe may comprise an inlet pipe and an inner pipe extending from an end of the inlet pipe. Also, the muffler pipe may comprise an overlapping portion where the end of the inlet pipe and an end of the inner pipe overlap each other. The outer wall coupling portion, the attachment member coupling portion, and the overlapping portion of the muffler pipe may be welded together. With this configuration, more secure coupling of the pipe and the muffler can be achieved.

BRIEF DESCRIPTION OF THE DRAWINGS

Some embodiments of the present disclosure will be described hereinafter by way of example with reference to the accompanying drawings, in which.

DETAILED DESCRIPTION OF THE PREFERRED EMBODIMENTS

Embodiments of the present disclosure are not limited to below-described embodiments, but may be in various forms within the technical scope of the present disclosure.

[Description of Configuration]

Figure 1:
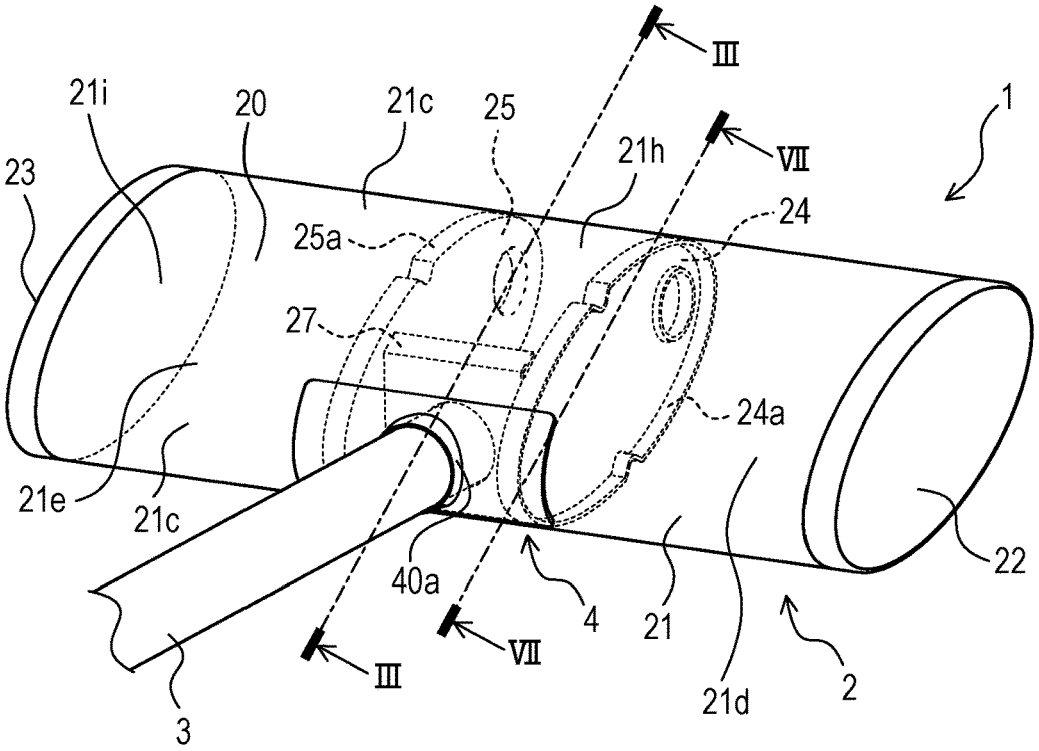
FIG. 1 is a perspective view of a muffler system transparently showing inside a muffler.
Figure 2:
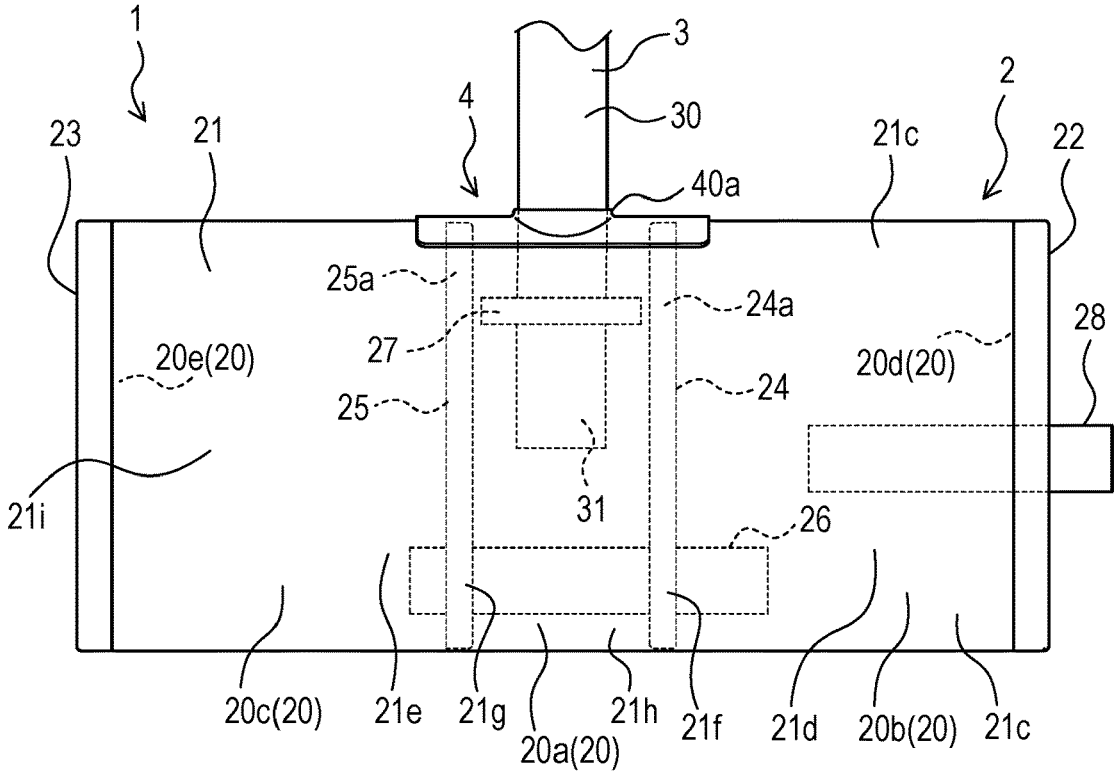
FIG. 2 is a bottom view of the muffler system transparently showing inside the muffler.

FIGS. 1 and 2 show a muffler system 1 of one embodiment that is installed in a vehicle, and is specifically provided in an exhaust flow path from an engine of the vehicle. The muffler system 1 comprises a muffler 2 and a muffler pipe 3. In one example, the muffler 2 and the muffler pipe 3 are made of stainless steel. The muffler 2 has a columnar configuration with an oval or substantially oval cross section orthogonal to its extending direction. The muffler 2 may have a columnar configuration, for example, with a circular or substantially circular cross section.

Hereinafter, a direction along a long diameter in the cross section of the muffler 2 is referred to as a "long diameter direction", and a direction along a short diameter in the cross section is referred to as a "short diameter direction". Also, an area of a lateral surface of the muffler 2 extending along the long diameter direction is referred to as a "long diameter area 21*i*", and an area of the lateral surface of the muffler 2 extending along the short diameter direction is referred to as a "short diameter area 21*c*". That is, the lateral surface of the muffler 2 comprises two long diameter areas 21*i* and two short diameter areas 21*c*. The two long diameter areas 21*i* face each other along the short diameter direction, and two short diameter areas 21*c* face each other along the long diameter direction.

Hereinafter, "upper", "upper side", and "upward" in the vehicle, in which the muffler 2 is installed, are simply referred to as "upper", "upper side" and "upward", respectively; and "lower", "lower side", and "downward" in the vehicle are simply referred to as "lower", "lower side", and "downward", respectively. The muffler 2 is installed in the vehicle in an inclined state where one of the long diameter areas 21*i* faces a bottom surface of the vehicle, and one of the short diameter areas 21*c* is positioned at the upper side. The muffler pipe 3 is arranged to project from the short diameter area 21*c* located at the lower side. A projection direction of the muffler pipe 3 is inclined downward. In this connection, an orientation of the muffler 2 installed in the vehicle and the projection direction of the muffler pipe 3 are not limited to those as described above. Specifically, for example, the muffler 2 may be arranged such that the long diameter direction is parallel to the bottom surface of the vehicle, or may be arranged inclined such that one end plate of the muffler 2 is located at the upper side. The projection direction of the muffler pipe 3 may be, for example, parallel to the bottom surface of the vehicle, or may be inclined upward.

An exhaust gas (exhaust) from the engine flows downstream through the muffler pipe 3 and flows into a muffling space 20 provided inside the muffler 2, and muffling is performed in the muffling space 20. The muffling space 20 comprises a first end 20*d* and a second end 20*e* facing the first end 20*d*. After muffling is performed, the exhaust gas flows out of the muffler 2 and is emitted from the vehicle.

The muffler 2 comprises a shell 21, a first end plate 22, a second end plate 23, a first separator 24, a second separator 25, an intermediate pipe 26, a support member 27, an outlet pipe 28, and an attachment member 4. The shell 21 and the first and second end plates 22, 23 form an outer wall that covers the muffling space 20. In FIG. 1, the intermediate pipe 26 and the outlet pipe 28 are omitted.

The shell 21 is a tubular member having a substantially oval cross section orthogonal to its extending direction, and covers a lateral surface of the muffling space 20. That is, the shell 21 forms the lateral surface of the muffler 2. Thus, the above-described long diameter areas 21*i* and short diameter areas 21*c* are formed on the outer surface of the shell 21. The muffler 2 may be a tubular member having a substantially circular cross section. Also, the shell 21 may be formed by bending a rectangular plate-like member into a tubular shape. Further, the shell 21 may be formed by a singly arranged plate-like member, or may be formed by multiply (for example, doubly) arranged plate-like members.

The first end plate 22 is a plate-like member that covers an opening at one end of the shell 21. The second end plate 23 is a plate-like member that covers an opening at the other end of the shell 21. Specifically, the first end plate 22 covers the first end 20*d* of the muffling space 20, and the second end plate 23 covers the second end 20*e* of the muffling space 20. In one example, the first and second end plates 22, 23 each have a substantially oval shape.

The first separator 24 is a plate-like member that is arranged to face the first end plate 22 and partition the muffling space 20. In one example, the first separator 24 is arranged to be parallel to or substantially parallel to the first end plate 22. A coupling portion 24*a* is provided at an outer edge of the first separator 24. The coupling portion 24*a* is a wall-like portion that surrounds the first separator 24. An edge portion of the first separator 24 is bent in an L-shape, and the bent portion corresponds to the coupling portion 24*a*. The coupling portion 24*a* projects from the outer edge of the first separator 24 toward the first end plate 22 along the shell 21. The coupling portion 24*a* may project, for example, toward the second end plate 23.

The second separator 25 is a plate-like member that is arranged between the first separator 24 and the second end plate 23 to face the second end plate 23 and partition the muffling space 20. In one example, the second separator 25 is arranged to be parallel to or substantially parallel to the second end plate 23. The second separator 25 has a configuration similar to the first separator 24, having an outer edge provided with a coupling portion 25*a*. The coupling portion 25*a* projects toward the second end plate 23. The coupling portion 25*a* may project, for example, toward the first end plate 22.

The coupling portions 24*a*, 25*a* of the first and second separators 24, 25 are each joined to an inner side of the shell 21, for example, by welding, swaging, or the like. Each of these coupling portions 24*a*, 25*a* may be configured as a plurality of wall-like portions.

The first and second end plates 22, 23 and the first and second separators 24, 25 have similar shapes and are arranged along the extending direction of the tubular shell 21. An additional separator may be provided, for example, between the first end plate 22 and the first separator 24 and/or between the second end plate 23 and the second separator 25.

The muffling space 20 comprises an intermediate space 20*a*, a first space 20*b*, and a second space 20*c*. The intermediate space 20*a* is an area located between the first separator 24 and the second separator 25, the first space 20*b* is an area located between the first separator 24 and the first end plate 22, and the second space 20*c* is an area located between the second separator 25 and the second end plate 23.

The intermediate pipe 26 is arranged in the intermediate space 20*a* with one end positioned in the first space 20*b* and the other end positioned in the second space 20*c*. Specifically, the first and second separators 24, 25 each comprises a hole, and the intermediate pipe 26 passes through the holes and is held by the peripheries of the holes. The intermediate pipe 26 extending along the extending direction of the shell 21 is positioned in a vicinity of the short diameter area 21*c* where the muffler pipe 3 is not provided.

A lateral surface of the intermediate pipe 26 may comprise one or more holes to allow passage of exhaust gas. Also, the first and second separators 24, 25 each may comprise one or more holes to allow passage of exhaust gas.

Figure 3:
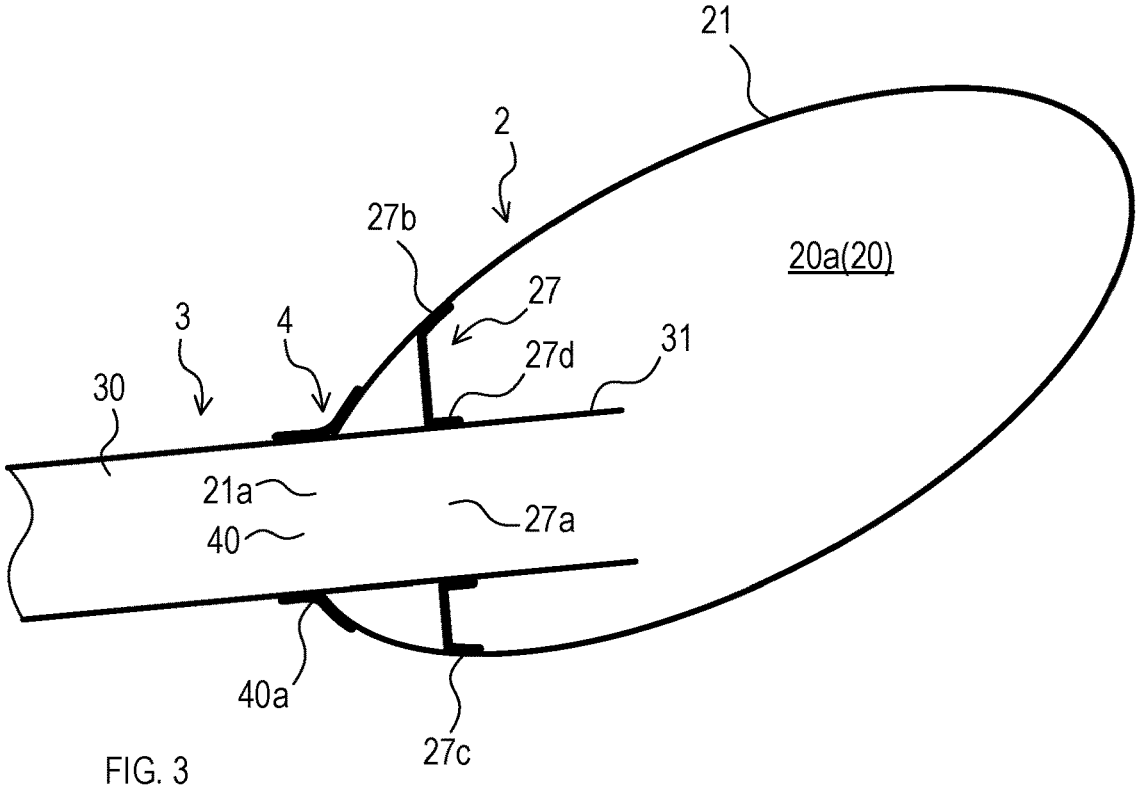
FIG. 3 is a schematic sectional view of the muffler along a line III-III in FIG. 1.

As shown in FIGS. 1 to 3, the muffler pipe 3 is provided to pass through a shell hole 21*a* that penetrates the shell 21. The shell hole 21*a* is provided in an area of the shell 21 that covers the intermediate space 20*a* (hereinafter referred to as an intermediate area 21*h*). Thus, one end of the muffler pipe 3 is positioned in the intermediate space 20*a*, and the muffler pipe 3 communicates between the intermediate space 20*a* and an exterior space of the muffler 2.

The shell hole 21*a* is provided, for example, at a central part of the shell 21 in its extending direction. The shell hole 21*a* is located at least partially in the short diameter area 21*c* of the shell 21. The shell hole 21*a* is located, for example, at an upper side of the short diameter area 21*c*. However, the shell hole 21*a* may be located, for example, at a lower side of the short diameter area 21*c*. Also, for example, the shell hole 21*a* may be entirely located in the long diameter area 21*i*.

Figure 4:
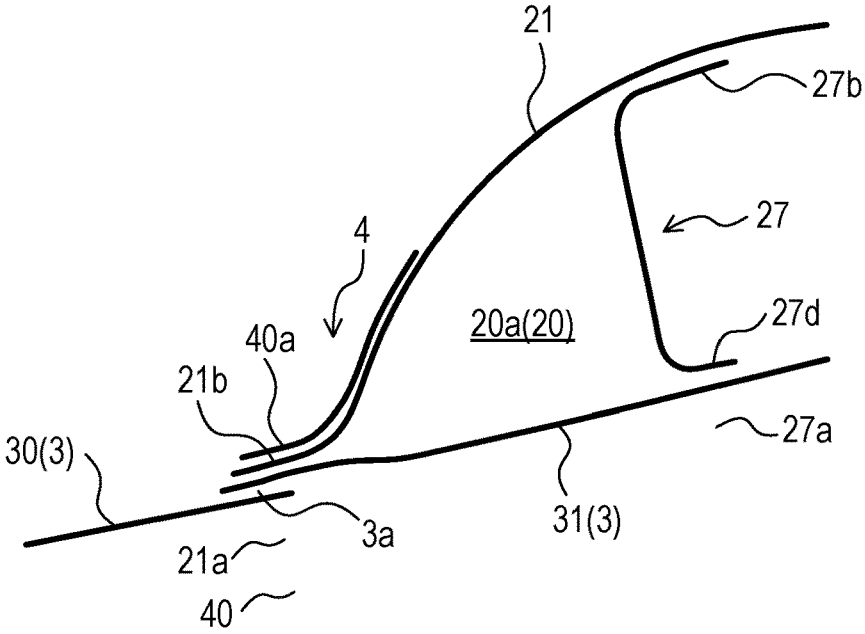
FIG. 4 is a partially enlarged schematic sectional view of the muffler along the line in FIG. 1.

As shown in FIGS. 3 and 4, burring is performed on an area of the shell 21 surrounding the shell hole 21*a*. Specifically, the shell 21 comprises a shell coupling portion 21*b* that surrounds the shell hole 21*a*. The shell coupling portion 21*b* is a wall-like portion extending along an edge of the shell hole 21*a* and projecting outward of the muffler 2. The shell coupling portion 21*b* is joined to the lateral surface of the muffler pipe 3 to hold the muffler pipe 3.

The muffler pipe 3 comprises an inlet pipe 30 and an inner pipe 31. The inner pipe 31 comprises one end coupled to the shell hole 21*a* and the other end arranged centrally in the intermediate space 20*a*. The inlet pipe 30 comprises one end coupled to the shell hole 21*a* and projects outward from the shell hole 21*a*. That is, the one end of the inlet pipe 30 and the one end of the inner pipe 31 are coupled inward of the shell coupling portion 21*b*. The muffler pipe 3 may be configured as a single pipe.

As shown in FIGS. 1 to 5, the attachment member 4 comprises a substantially quadrangular plate-like member comprising an attachment member hole 40 in its central area. The attachment member 4, for example, has a substantially rectangular shape and extends along the longitudinal direction. The attachment member 4 is also called as a "patch". The attachment member 4 is arranged along the outer surface of the shell 21 to cover a periphery of the shell hole 21*a*. As a result, the shell coupling portion 21*b* is located in the attachment member hole 40. Also, the muffler pipe 3 is located in the attachment member hole 40.

The outer surface of the shell 21 comprises a first area 21*d* and a second area 21*e*. The first area 21*d* is located between the first end plate 22 and an area of the outer surface of the shell 21 facing the coupling portion 24*a* of the first separator 24 (hereinafter referred to as a "first facing area 21*f*"). The second area 21*e* is located between the second end plate 23 and an area of the outer surface of the shell 21 facing the coupling portion 25*a* of the second separator 25 (hereinafter referred to as a "second facing area 21*g*"). The attachment member 4 is welded to the first area 21*d* and the second area 21*e*. The attachment member 4 may be also welded to another area in the outer surface of the shell 21 in addition to the first area 21*d* and the second area 21*e*.

The attachment member 4 comprises two first corner portions 41, 42 and two second corner portions 43, 44 adjacent to corresponding four corners of the attachment member 4. In one example, the first corner portions 41, 42, which are welding portions provided at one longitudinal end of the attachment member 4, are spot-welded to the first area 21*d*, and the second corner portions 43, 44, which are welding portions provided at the other longitudinal end of the attachment member 4, are spot-welded to the second area 21*e*.

Specifically, the first corner portions 41, 42 are arranged along one short side of the attachment member 4, and the second corner portions 43, 44 are arranged along the other short side of the attachment member 4. The attachment member 4 is arranged with its long side oriented along the extending direction of the shell 21 such that the first corner portions 41, 42 abut the first area 21*d*, and the second corner portions 43, 44 abut the second area 21*e*.

The first corner portion 41, 42 are spot-welded, at points w, to a part of the first area 21*d* adjacent to the first facing area 21*f*. Also, the second corner portions 43, 44 are spot-welded, at points w, to a part of the second area 21*e* adjacent to the second facing area 21*g*.

The first corner portions 41, 42 may be spot-welded to a part of the first area 21*d* apart from the first facing area 21*f*. Also, the second corner portions 43, 44 may be spot-welded to a part of the second area 21*e* apart from the second facing area 21*g*.

The attachment member 4 may have a shape other than a rectangular shape. Specifically, the attachment member 4 may have, for example, a substantially square shape. Also in this case, two corner portions may be spot-welded to the first area 21*d*, and the remaining two corner portions may be spot-welded to the second area 21*e* in a similar manner.

Further, for example, in addition to the corner portions of the attachment member 4, or in place of the corner portions of the attachment member 4, a portion other than the corner portions of the attachment member 4 may be welded to the first area 21*d* or the second area 21*e*. Specifically, welding may be performed, for example, along an edge of the attachment member 4 located in the first area 21*d* or the second area 21*e*.

The attachment member 4 may be joined to the first area 21*d* and the second area 21*e* by welding other than spot-welding.

Figure 5:
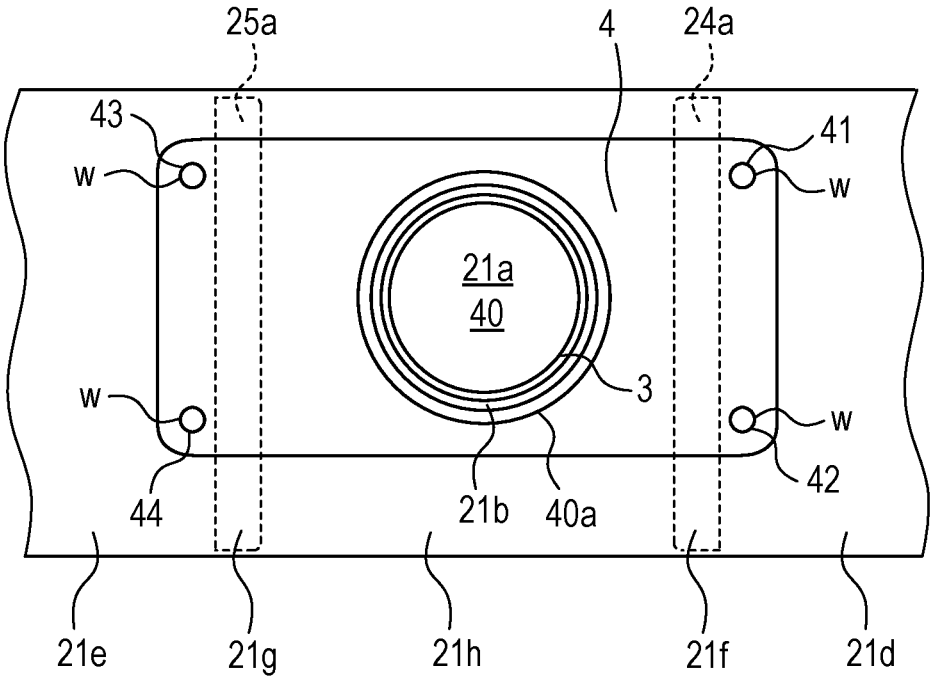
FIG. 5 is a front view of an attachment member.

As shown in FIGS. 4 and 5, the attachment member 4 comprises an attachment member coupling portion 40*a* surrounding the attachment member hole 40. The attachment member coupling portion 40*a* is a wall-like portion extending along an edge of the attachment member hole 40 and projecting outward of the muffler 2. The attachment member coupling portion 40*a* may be formed by burring. The attachment member coupling portion 40*a* is located outward of the shell coupling portion 21*b*, which is located in the attachment member hole 40.

As described above, the muffler pipe 3 is arranged inward of the shell coupling portion 21*b*. The muffler pipe 3 comprises the inlet pipe 30 and the inner pipe 31, and the one end of the inlet pipe 30 and the one end of the inner pipe 31 are coupled inward of the shell coupling portion 21*b*.

Specifically, a portion of the inlet pipe 30 including the one end and a portion of the inner pipe 31 including the one end overlap each other. Although the inlet pipe 30 is located inward of the inner pipe 31 by way of example, the inlet pipe 30 may be located outward of the inner pipe 31. An overlapping portion of the inlet pipe 30 and the inner pipe 31 (hereinafter referred to as a "pipe overlapping portion 3*a*") is arranged inward of the shell coupling portion 21*b*.

That is, the pipe overlapping portion 3*a*, the shell coupling portion 21*b*, and the attachment member coupling portion 40*a* are arranged to overlap one another, and these are joined by entire circumferential welding. As a result, the attachment member coupling portion 40*a* and the muffler pipe 3 are fixed to each other. Specifically, welding may be performed, for example, along a circumferential path surrounding the attachment member hole 40 in the attachment member coupling portion 40*a*, which is outward positioned. Entire circumferential welding is not always required, and welding may be performed, for example, at a plurality of points along a circumferential path of the attachment member coupling portion 40*a*.

The support member 27 is a substantially rectangular plate-like member having a support member hole 27*a* in its center, and is also called as a "stay". The support member 27 is arranged in the intermediate space 20*a* to face the shell hole 21*a*. The support member 27 is arranged to extend from an inner surface of one of the long diameter areas 21*i* (hereinafter, a "first long diameter area") of the shell 21 to an inner surface of the other of the long diameter areas 21*i* (hereinafter, a "second long diameter area"). Specifically, the support member 27 comprises two sides facing each other and including respective first and second coupling portions 27*b*, 27*c* formed by bending ends of the support member 27. The first coupling portion 27*b* is joined to the inner surface of the first long diameter area 21*i* of the shell 21, the second coupling portion 27*c* is joined to the inner surface of the second long diameter area 21*i*. The first and second coupling portions 27*b*, 27*c* and the inner surfaces of the shell 21 may be joined, for example, by welding or swaging.

The support member 27 also comprises a support member coupling portion 27*d* surrounding the support member hole 27*a*. The support member coupling portion 27*d* is a wall-like portion extending along an edge of the support member hole 27*a* and projecting opposite to the shell hole 21*a*.

The muffler pipe 3 (more specifically, the inner pipe 31) is arranged to pass through the support member hole 27*a*. In this state, the lateral surface of the muffler pipe 3 is supported by the support member coupling portion 27*d*.

The support member coupling portion 27*d* may project from the edge of the support member hole 27*a* toward the shell hole 21*a*. Also, the support member coupling portion 27*d* may be configured as a plurality of wall-like portions.

The outlet pipe 28 is configured to discharge exhaust gas from the muffling space 20. The outlet pipe 28 is arranged to pass through a hole provided in a center of the first end plate 22. The outlet pipe 28 comprises one end located in the first space 20*b* and the other end located outside the muffler 2.

[Effects]

(1) Since the first and second separators 24, 25 are provided inside the muffler 2 of the above-described embodiment, the first and second areas 21*d*, 21*e* of the shell 21 each have a rigidity greater than that of the intermediate area 21*h* of the shell 21.

Figure 6:
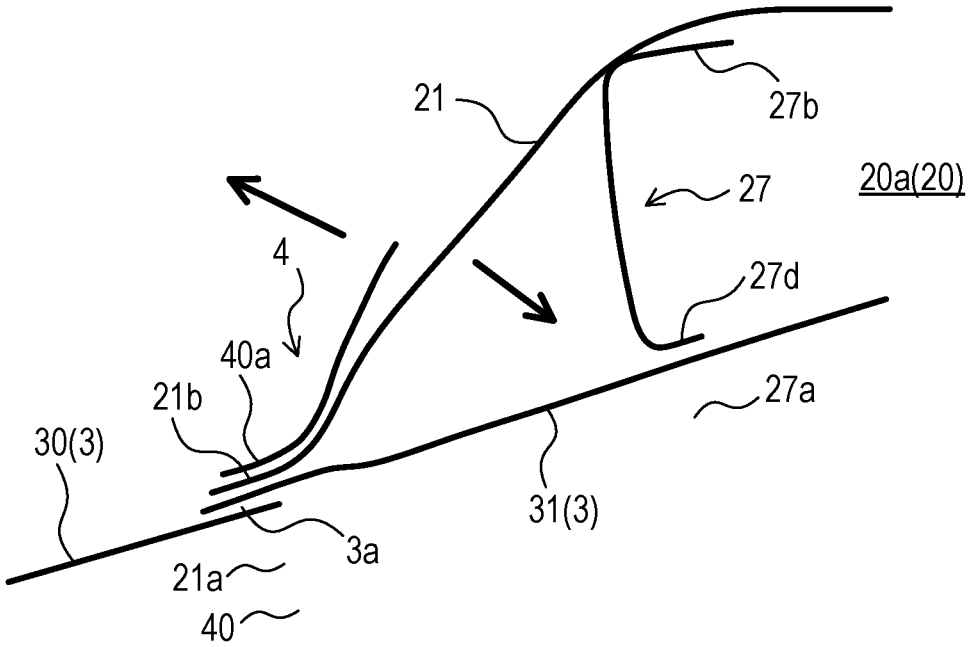
FIG. 6 is a partially enlarged schematic sectional view of the muffler along the line in FIG. 1 when a shell is deformed by an external force applied to a muffler pipe (in other words, an inlet pipe)
Figure 7:
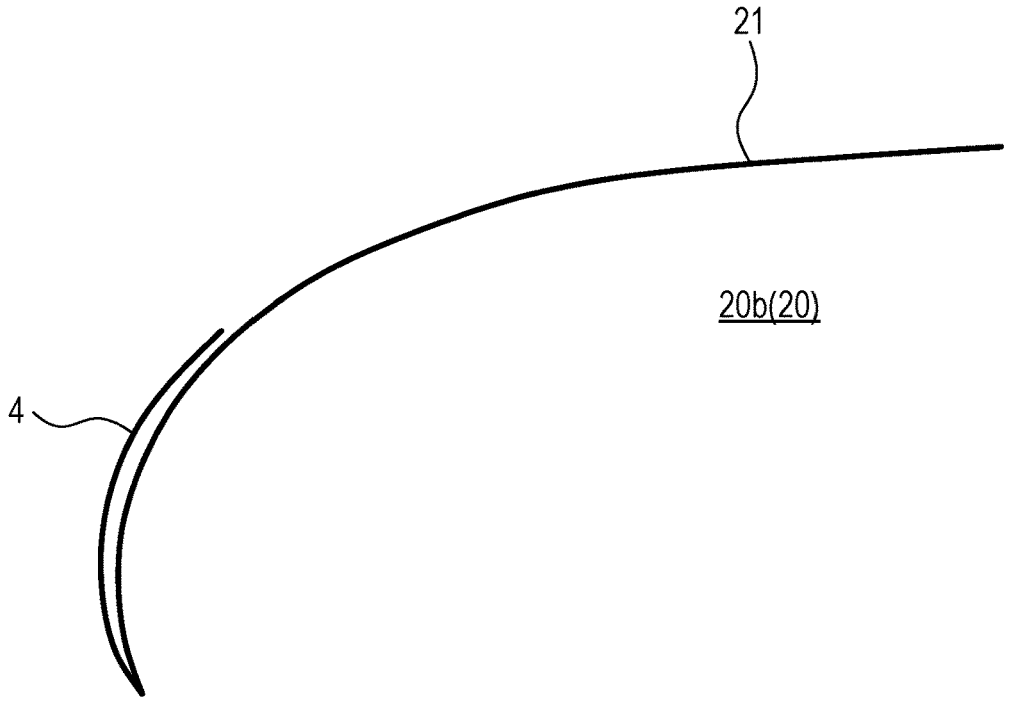
FIG. 7 is a partially enlarged schematic sectional view of the muffler along a line VII-VII in FIG. 1 when the shell is deformed by an external force applied to the muffler pipe (in other words, the inlet pipe)

Assume that a downward external force is applied to the muffler pipe 3 (more specifically, the inlet pipe 30) in a case where the attachment member 4 is welded to the intermediate area 21*h*. Then, as shown in FIG. 6, a force is applied to the attachment member 4 in a direction of separating an upper part of the attachment member 4 from the shell 21. The external force also presses the shell coupling portion 21*b* downward. In this case, such pressing may cause deformation of the shell 21 due to the low rigidity of the intermediate area 21*h*, resulting in depression of the intermediate area 21*h* above the shell hole 21*a*. On the other hand, as shown in FIG. 7, deformation of the first and second areas 21*d*, 21*e* is reduced due to their high rigidity even if the external force is applied to the muffler pipe 3.

In contrast, according to the above-described embodiment, the attachment member 4 is welded to both of the first and second areas 21*d*, 21*e* of the shell 21. The first and second areas 21*d*, 21*e* having high rigidity are less likely to be deformed despite an external force applied to the muffler pipe 3. Thus, separation of the attachment member 4 from the outer surface of the shell 21 is reduced. Accordingly, more secure coupling of the muffler pipe 3 and the muffler 2 can be achieved.

(2) The lateral surface of the muffler pipe 3 (more specifically, the inner pipe 31) is supported by the support member 27 in the intermediate space 20*a* inside the muffler 2. Thus, if an external force is applied to the muffler pipe 3, change of an orientation of the muffler pipe 3 is reduced, and also deformation of the shell 21 is reduced. Accordingly, separation of the attachment member 4 from the outer surface of the shell 21 is reduced, and more secure coupling of the muffler pipe 3 and the muffler 2 can be achieved.

(3) The attachment member 4 is a substantially quadrangular plate-like member with four corner portions that are welded to the shell 21. This enables more secure welding of the attachment member 4 to the shell 21 with reduced cost.

OTHER EMBODIMENTS (1) The shape of the attachment member 4 of the above-described embodiment is not limited a substantially rectangular shape. Specifically, the attachment member 4 may comprises a rectangular main portion 45 and first to fourth welding portions 45*a* to 45*d*. The first to fourth welding portions 45*a* to 45*d* may be provided at respective corner portions of the main portion 45. The attachment member 4 may be arranged such that long sides of the main portion 45 are positioned along the extending direction of the shell 21.

Figure 8:
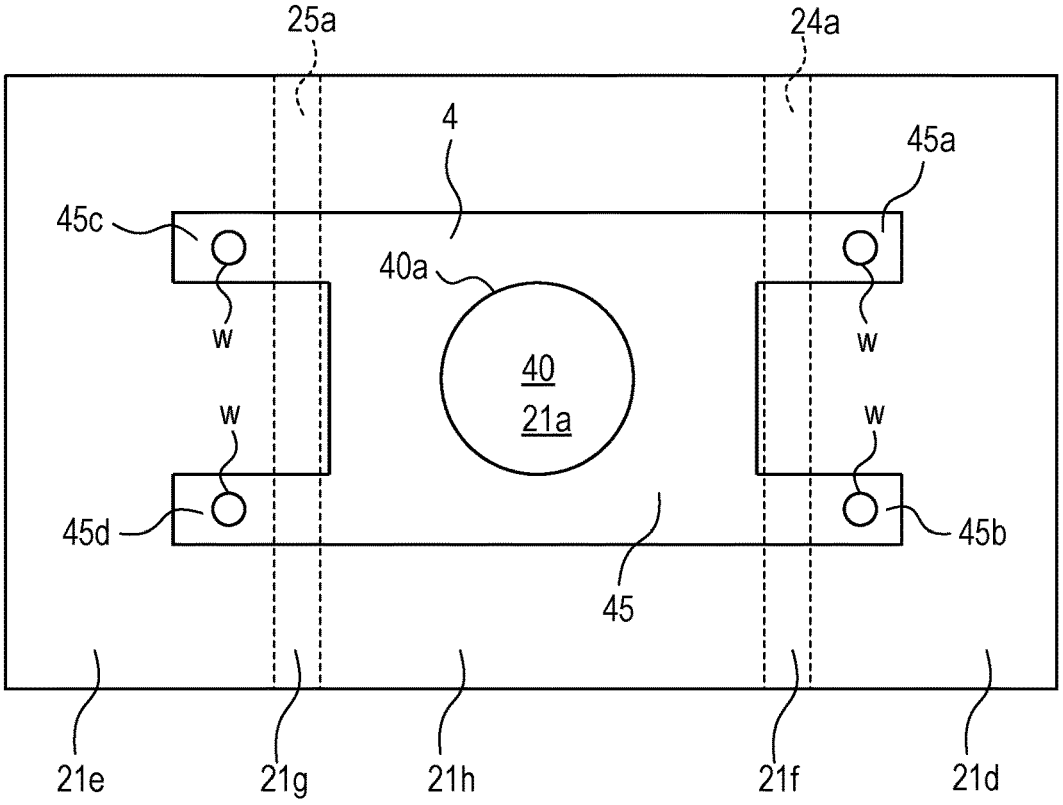
FIG. 8 is a front view of an attachment member in another embodiment.

Also, as shown in FIG. 8, the attachment member 4 may be arranged such that the main portion 45 covers the intermediate area 21*h*. Alternatively, the attachment member 4 may be arranged such that the main portion 45 covers the intermediate area 21*h* and the first and second facing areas 21*f*, 21*g*.

Further, the first and second welding portions 45*a*, 45*b* may be rectangular portions projecting from respective end portions of one short side of the main portion 45. The first and second welding portions 45*a*, 45*b* may be spot-welded, at points w, to the first area 21*d*. Also, the third and fourth welding portions 45*c*, 45*d* may be rectangular portions projecting from respective end portions of the other short side of the main portion 45. The third and fourth welding portions 45*c*, 45*d* may be spot-welded, at points w, to the second area 21*e*.

Figure 9:
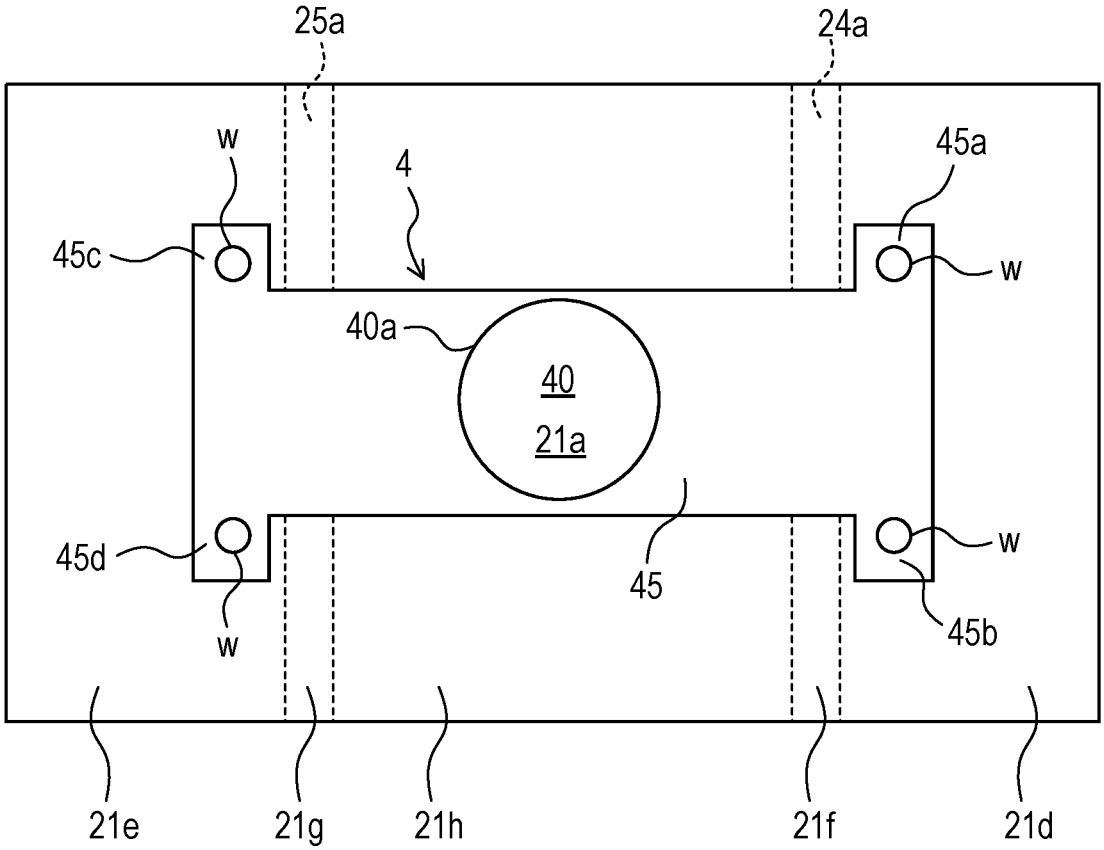
FIG. 9 is a front view of an attachment member in a further embodiment.

Further, as shown in FIG. 9, the attachment member 4 may be arranged such that the main portion 45 covers the intermediate area 21*h*, the first and the second facing areas 21*f*, 21*g*, and the first and second areas 21*d*, 21*e*.

The first and second welding portions 45*a*, 45*b* may be rectangular portions projecting from respective end portions of one long side of the main portion 45. The first and second welding portions 45*a*, 45*b* may be spot-welded, at points w, to the first area 21*d*. The third and fourth welding portions 45*c*, 45*d* may be rectangular portions projecting from respective end portions of the other long side of the main portion 45. The third and fourth welding portion 45*c*, 45*d* may be spot-welded, at points w, to the second area 21*e*.

The first to fourth welding portions 45*a* to 45*d* may be welded by welding other than spot-welding.

In such cases, similar effects as described above can be obtained.

(2) In the above-described embodiment, the outer wall of the muffler 2 is configured with the tubular shell 21 and the first and second end plates 22, 23. However, the outer wall may be configured with, for example, a first member covering the muffling space 20 from above and a second member covering the muffling space 2 from below, wherein the first and second members are joined to each other.

(3) A plurality of functions performed by a single element in the above-described embodiment may be achieved by a plurality of elements, or a function performed by a single element may be achieved by a plurality of elements. Alternatively, a plurality of functions performed by a plurality of elements may be achieved by a single element, or a function performed by a plurality of elements may be achieved by a single element. Also, a part of a configuration in the above-described embodiments may be omitted. Further, at least a part of a configuration in the above-described embodiments may be added to, or may replace, a configuration in other embodiment described above.

CORRESPONDENCE WITH CLAIMS

The shell hole 21*a* corresponds to an example of an outer wall hole. Also, the coupling portion 24*a* of the first separator 24 corresponds to an example of a first separator coupling portion, the coupling portion 25*a* of the second separator 25 corresponds to an example of a second separator coupling portion, and the shell coupling portion 21*b* corresponds to an example of an outer wall coupling portion.

What is claimed is:

1. A muffler system provided in an exhaust flow path from an engine of a vehicle and having a muffler, the muffler system comprising:

an outer wall covering a muffling space inside the muffler, the outer wall comprising:

a tubular shell extending between a first and a second end of the muffling space;

a first end plate comprising a plate-like member covering the first end; and a second end plate comprising a plate-like member covering the second end;

a first separator that comprises a plate-like member arranged to face the first end plate and partition the muffling space, the first separator comprising a first separator coupling portion that is provided at an edge of the first separator and joined to an inner side of the tubular shell;

a second separator that comprises a plate-like member arranged, between the second end plate and the first separator, to face the second end plate and partition the muffling space, the second separator comprising a second separator coupling portion that is provided at an edge of the second separator and joined to the inner side of the tubular shell;

a muffler pipe arranged to pass through an outer wall hole provided in a part of the tubular shell covering an intermediate space of the muffling space, the intermediate space being defined between the first separator and the second separator, such that the muffler pipe communicates the intermediate space with an exterior space of the muffler; and an attachment member that comprises a plate-like member having an attachment member hole and an attachment member coupling portion surrounding the attachment member hole, the attachment member being arranged along an outer surface of the tubular shell, and the muffler pipe being arranged to pass through the attachment member hole and secured to the attachment member coupling portion, wherein the outer surface of the tubular shell comprises a first area and a second area, the first area being located between the first end and an area facing the first separator coupling portion, and the second area being located between the second end and an area facing the second separator coupling portion, wherein the attachment member is welded to at least the first area and the second area of the outer surface of the tubular shell, wherein the attachment member includes a first portion extending to the first area, the first portion extends along the first separator, and both ends of the first portion along an extending direction are joined to the tubular shell, and wherein the attachment member includes a second portion extending to the second area, the second portion extends along the second separator, and both ends of the second portion along an extending direction are joined to the tubular shell.

2. The muffler system according to claim 1, wherein the outer wall extends between the first end and the second end, and has a columnar configuration having a substantially oval cross section orthogonal to an extending direction of the outer wall.

3. The muffler system according to claim 2, wherein an outer surface of the outer wall comprises a short diameter area extending along a short diameter direction of the cross section, and wherein the outer wall hole is provided to be located at least partially in the short diameter area.

4. The muffler system according to claim 1, further comprising:

a support member that comprises a plate-like member having a support member hole and a support member coupling portion surrounding the support member hole, and is arranged in the intermediate space with the muffler pipe passing through the support member hole, wherein the support member is joined to the inner side of the outer wall, and wherein the support member coupling portion supports a lateral surface of the muffler pipe.

5. The muffler system according to claim 4, wherein the outer wall extends between the first end and the second end, and has a columnar configuration having a substantially oval cross section orthogonal to an extending direction of the outer wall, wherein an outer surface of the outer wall comprises a first long diameter area and a second long diameter area each extending along a long diameter direction of the cross section, and wherein the support member is joined to an inner side of the first long diameter area and to an inner side of the second long diameter area.

6. The muffler system according to claim 1, wherein the attachment member comprises a substantially quadrangular member, and wherein at least two of four corner portions of the attachment member are welded to the first area, and the remaining two of the four corner portions are welded to the second area.

7. The muffler system according to claim 1, wherein the attachment member comprises a substantially rectangular portion extending along a longitudinal direction, and wherein one end of the substantially rectangular portion along the longitudinal direction comprises at least one welding portion welded to the first area, and the other end of the substantially rectangular portion along the longitudinal direction comprises at least one welding portion welded to the second area.

8. The muffler system according to claim 1, wherein the outer wall comprises an outer wall coupling portion that is a wall-like portion surrounding the outer wall hole and projecting from an edge of the outer wall hole outward of the muffler, wherein the attachment member coupling portion is a wall-like portion surrounding the attachment member hole and projecting from an edge of the attachment member hole outward of the muffler, and the attachment member coupling portion is arranged outward of the outer wall coupling portion, and wherein the outer wall coupling portion, the attachment member coupling portion, and the muffler pipe are welded together.

9. The muffler system according to claim 8, wherein the muffler pipe comprises an inlet pipe and an inner pipe extending from an end of the inlet pipe, wherein the muffler pipe comprises an overlapping portion where the end of the inlet pipe and an end of the inner pipe overlap each other, and wherein the outer wall coupling portion, the attachment member coupling portion, and the overlapping portion of the muffler pipe are welded together.

10. The muffler system according to claim 6, wherein the attachment member comprises a substantially rectangular portion extending along a longitudinal direction, and wherein a portion located at one end of the attachment member along the longitudinal direction is the first portion extending to the first area, and a portion located at an other end of the attachment member along the longitudinal direction is the second portion extending to the second area.

11. The muffler system according to claim 1, wherein the attachment member comprises a substantially quadrangular member that includes a first to a fourth edge portions, the first edge portion and the third edge portion facing each other, and the second edge portion and the fourth edge portion facing each other, wherein the first edge portion is included in the first portion, wherein the third edge portion is included in the second portion, wherein both ends of the first portion are provided with first protrusions protruding from respective edges of the second edge portion and the fourth edge portion, and wherein both ends of the second portion are provided with second protrusions protruding from respective edges of the second edge portion and the fourth edge portion.

12. A muffler system provided in an exhaust flow path from an engine of a vehicle and having a muffler, the muffler system comprising:

an outer wall covering a muffling space inside the muffler;

a first separator that comprises a plate-like member arranged to face a first end of the muffling space and partition the muffling space, the first separator further comprising a first separator coupling portion that is provided at an edge of the first separator and joined to an inner side of the outer wall;

a second separator that comprises a plate-like member arranged, between the first separator a second end of the muffling space opposing the first end, to face the second end and partition the muffling space, the second separator further comprising a second separator coupling portion that is provided at an edge of the second separator and joined to the inner side of the outer wall;

a muffler pipe arranged to pass through an outer wall hole provided in a part of the outer wall covering an intermediate space of the muffling space, the intermediate space being defined between the first separator and the second separator, such that the muffler pipe communicates the intermediate space with an exterior space of the muffler; and an attachment member that comprises a plate-like member having an attachment member hole and an attachment member coupling portion surrounding the attachment member hole, wherein the attachment member is arranged along an outer surface of the outer wall, wherein the muffler pipe is arranged to pass through the attachment member hole and is secured to the attachment member coupling portion, wherein the outer surface of the outer wall comprises a first area and a second area, the first area being located between the first end and an area facing the first separator coupling portion, and the second area being located between the second end and an area facing the second separator coupling portion, wherein the attachment member is welded to at least the first area and the second area of the outer surface of the outer wall, wherein the attachment member has a substantially quadrangular shape, and wherein at least two of four corner portions of the attachment member are welded to the first area, and the remaining two of the four corner portions are welded to the second area.

13. A muffler system provided in an exhaust flow path from an engine of a vehicle and having a muffler, the muffler system comprising:

an outer wall covering a muffling space inside the muffler;

a first separator that comprises a plate-like member arranged to face a first end of the muffling space and partition the muffling space, the first separator further comprising a first separator coupling portion that is provided at an edge of the first separator and joined to an inner side of the outer wall;

a second separator that comprises a plate-like member arranged, between the first separator a second end of the muffling space opposing the first end, to face the second end and partition the muffling space, the second separator further comprising a second separator coupling portion that is provided at an edge of the second separator and joined to the inner side of the outer wall;

a muffler pipe arranged to pass through an outer wall hole provided in a part of the outer wall covering an intermediate space of the muffling space, the intermediate space being defined between the first separator and the second separator, such that the muffler pipe communicates the intermediate space with an exterior space of the muffler; and an attachment member that comprises a plate-like member having an attachment member hole and an attachment member coupling portion surrounding the attachment member hole, wherein the attachment member is arranged along an outer surface of the outer wall, wherein the muffler pipe is arranged to pass through the attachment member hole and is secured to the attachment member coupling portion, wherein the outer surface of the outer wall comprises a first area and a second area, the first area being located between the first end and an area facing the first separator coupling portion, and the second area being located between the second end and an area facing the second separator coupling portion, wherein the attachment member is welded to at least the first area and the second area of the outer surface of the outer wall, wherein the attachment member has a substantially rectangular portion extending along a longitudinal direction, and wherein one end of the substantially rectangular portion along the longitudinal direction comprises at least one welding portion welded to the first area, and the other end of the substantially rectangular portion along the longitudinal direction comprises at least one welding portion welded to the second area.

14. The muffler system according to claim 13, wherein the attachment member comprises a substantially quadrangular member that includes a first to a fourth edge portions, the first edge portion and the third edge portion facing each other, and the second edge portion and the fourth edge portion facing each other, wherein the attachment member includes a first longitudinal portion and a second longitudinal portion, the first longitudinal portion comprising the substantially rectangular portion that includes the second edge portion, and the second longitudinal portion comprising the substantially rectangular portion that includes the fourth edge portion, wherein both ends of the first longitudinal portion are provided with first protrusions protruding from respective first edges of the first edge portion and the third edge portion, wherein both ends of the second longitudinal portion are provided with second protrusions protruding from respective second edges of the first edge portion and the third edge portion, and wherein one of the first protrusions of the first longitudinal portion and one of the second protrusions of the second longitudinal portion are welded to the first area, and the other of the first protrusions of the first longitudinal portion and the other of the second protrusions of the second longitudinal portion are welded to the second area.

* * * * *